United States Patent [19]

Fleury

[11] Patent Number: 5,022,095

[45] Date of Patent: Jun. 11, 1991

[54] DISPOSABLE LINER FOR HARD HATS

[75] Inventor: Richard L. Fleury, Chicago, Ill.

[73] Assignee: GKR Industries, Inc., Alsip, Ill.

[21] Appl. No.: 369,611

[22] Filed: Jun. 21, 1989

[51] Int. Cl.[5] ..... A42C 5/00

[52] U.S. Cl. ..... 2/190; 2/410

[58] Field of Search ..... 2/63, 181, 181.4, 183, 2/190, 205, 272, 410

[56] References Cited

U.S. PATENT DOCUMENTS

| | | | |
|---|---|---|---|
| 1,239,376 | 9/1917 | Fodor | 2/63 |
| 1,479,670 | 1/1924 | McKnight | 2/190 |
| 1,561,172 | 11/1925 | Koch | 2/190 |
| 1,697,507 | 1/1929 | Karger | 2/190 |
| 1,904,108 | 4/1933 | Walsh | 2/190 |
| 3,055,012 | 9/1962 | Aileo | 2/410 |
| 3,205,508 | 9/1965 | Cox | 2/410 |
| 3,594,814 | 7/1971 | Schuessler | 2/410 |
| 4,091,469 | 5/1978 | Davidson | 2/410 |
| 4,845,782 | 7/1989 | Gregg | 2/183 |

*Primary Examiner*—Werner H. Schroeder
*Assistant Examiner*—Diana L. Biefeld
*Attorney, Agent, or Firm*—Baker & McKenzie

[57] ABSTRACT

The invention relates to an inexpensive, disposable liner for hard hats. The liner is shaped to be inserted into and resiliently engage the lower periphery of a hard hat. The liner includes an elastic band attached to the lower edge of the liner so that the liner can be slipped over the beak and the interior support of the hard hat. The liner is preferably made of a soft, breathable material which will prevent the buildup of moisture, and which will feel comfortable to the user. The sides of the liner are elongated so that the liner can be folded over the lower periphery of the hard hat. The elastic band attached to the lower edge of the liner allows the liner to be easily installed into and removed from the hard hat.

12 Claims, 2 Drawing Sheets

DISPOSABLE LINER FOR HARD HATS

BACKGROUND AND SUMMARY OF THE INVENTION

The invention relates generally to a protective liner for use with head wear. In particular, the invention is directed to a way of keeping hard hats, or users thereof, free of body oil, hair, dandruff and the like.

Prior art liners of various sorts have been used to protect hats from being soiled. For example, U.S. Pat. No. 1,077,833 to Houghton shows a removable sanitary hat lining which includes several plies of tissue paper held in place by a metal hoop with inwardly projecting fingers. The fingers engage apertures in a ring or band at the bottom edge of the paper plies.

U.S. Pat. No. 1,716,269 shows a detachable, ventilated hat lining which is adjustable. The lining is intended to be held in place by sharp pins bent to securely fasten the liner to a hat.

U.S. Pat. No. 1,852,930 shows a flat cellophane protective hat liner which is folded into position inside of a hat. The liner is held in place behind the sweatband of the hat being lined.

U.S. Pat. No. 1,986,312 shows a hat liner which protects only the sweatband of a hat.

U.S. Pat. No. 2,478,550 shows a liner for hats which includes a stiff base and a transparent crown. The liner is not intended to be attached to the hat with which it is used.

U.S. Pat. No. 3,069,690 shows a liner for a hat which is intended to be permanently attached to the interior of a hat by an adhesive.

Visitors to manufacturing plants and construction sites are usually required by law to wear protective headwear or hard hats. Plant managers and construction site supervisors generally keep a supply of hard hats on hand for use by such visitors. Keeping the hard hats clean is a significant problem. Hair care products, body oil, perspiration, and other unsanitary residue can quickly build up inside a hard hat which is used by various visitors. Hard hats generally have a somewhat complex support framework which is intended to cushion the user's head from impact. Such framework has a large number of surfaces on which residue can accumulate, and the framework is difficult to clean.

It is therefore an object of the present invention to provide means for preventing the buildup of residue on the inside of hard hats.

Another object of the invention is to prevent the spread of diseases, such as disease of the scalp, or unsanitary residue between users of hard hats.

Yet another object of the invention is to provide an inexpensive disposable liner for hard hats.

Still another object of the invention is to provide a disposable liner for hard hats which is comfortable to wear.

Another object of the invention is to provide a disposable liner for hard hats which is easily installed into and easily removed from a hard hat.

Still another object of the invention is to provide a liner for hard hats which is comfortable, breathable and moisture absorbent.

These and other objects of the invention are achieved with a liner made from a generally concave sheet of flaccid material. The liner has a top and downwardly extending sides. The shape is designed to loosely fit on the inside of a hard hat. The sides are elongated so that they may be folded into engagement with a hard hat and its framework. In order to make sure the liner is held in position inside the hard hat, a segment of the downwardly depending side of the liner is gathered and or pleated and attached to an elastic strip. The elastic strip, in conjunction with the gathered segment, allows the lower edge of the liner to resiliently grip the hard hat and framework.

BRIEF DESCRIPTION OF THE DRAWINGS

The above objects and advantages of the invention will become apparent upon reading the following specifications read in conjunction with the accompanying drawings wherein.

DETAILED DESCRIPTION OF THE INVENTION

Figure 1:
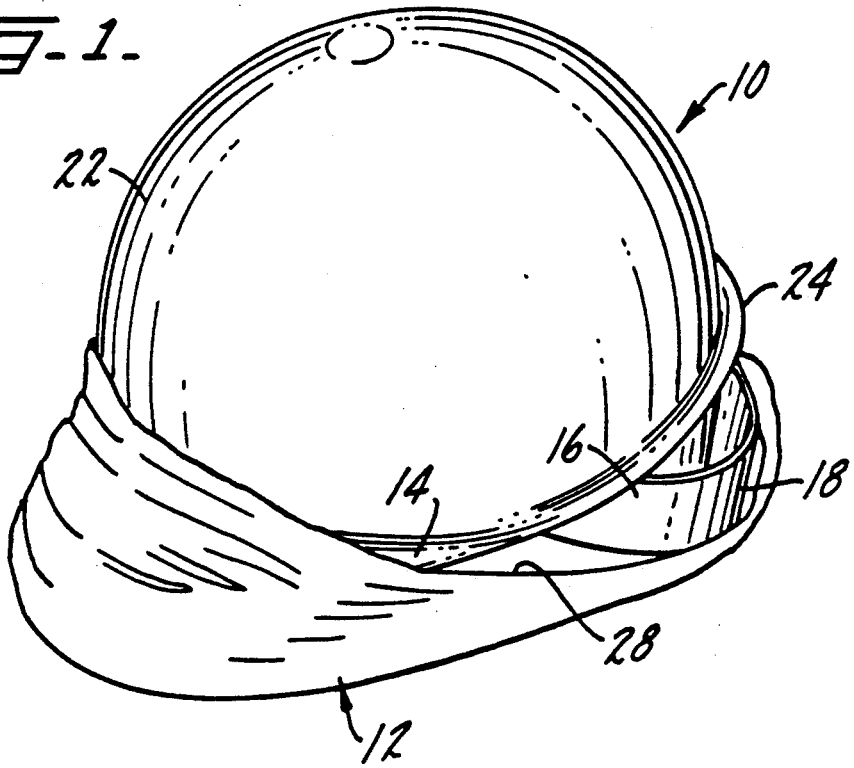
FIG. 1 is a perspective view of a hard hat with a liner of the present invention in its use position.
Figure 2:
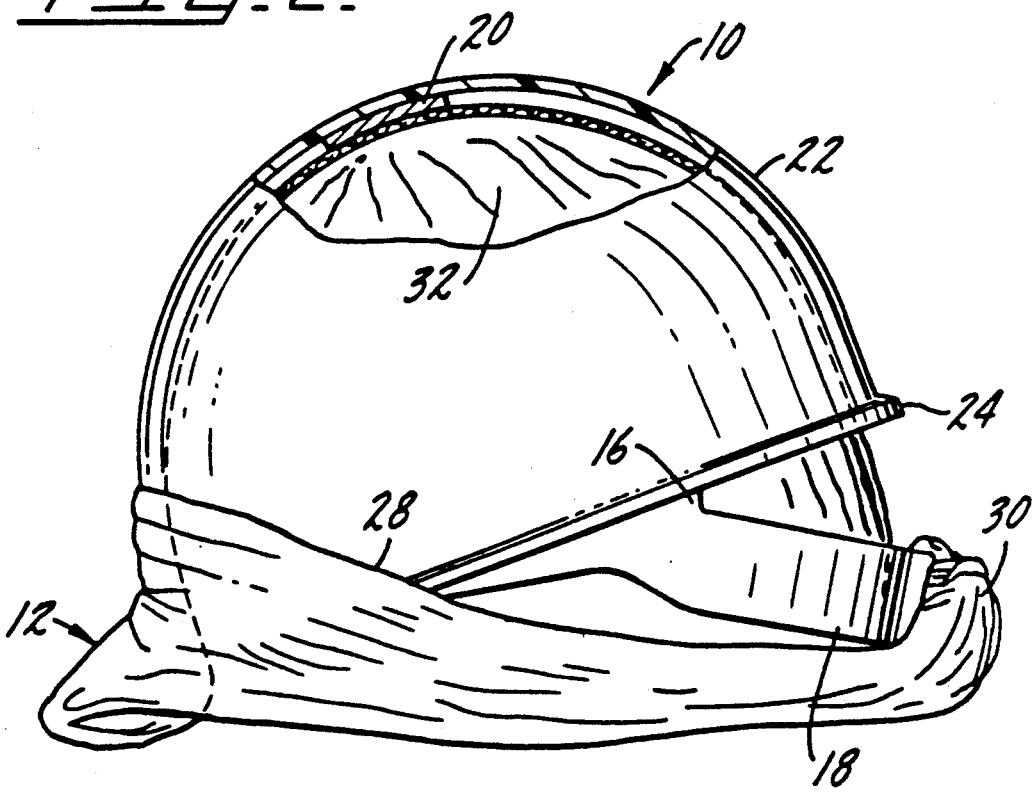
FIG. 2 is an elevational view in partial section of the hard hat and liner shown in FIG. 1.

FIGS. 1 and 2 show a typical hard hat 10 with the liner 12 of the present invention placed therein. The lower portion of the framework 16 extends from the bottom edge 24 of the rear of the hard hat. The visor 14 at the front of the hard hat 10 is covered by the upwardly folded edge 28, and engages the visor 14 and the rear portion of the band 18.

As will be discussed later with respect to FIGS. 3 and 4, the upwardly folded edge 28 includes a gathered section 30, which enables the upwardly folded edge 28 to resiliently surround and engage the front and rear portions of the hard hat.

The hard hat shown in FIGS. 1 and 2 includes an adjustment knob (not shown) on the band 18, which is used to adjust the diameter of the band to fit users with different head sizes. However, the invention may be used with various hard hats which may or may not have such a knob. On most hard hats, those with and without knobs, the rear portion of the band 18 extends below the bottom edge 24 of the shell 22. The rear portion of the band 18 positively engages the occipital portion of the user's head.

The liner extends into the shell 22 and the top 32 of the liner is adjacent to the upper framework 20, while the side of the liner are adjacent to lower portions of the framework 16. The user's head is, therefore, prevented from contacting any part of the shell 22 of the hard hat or the framework 16.

Figure 3:
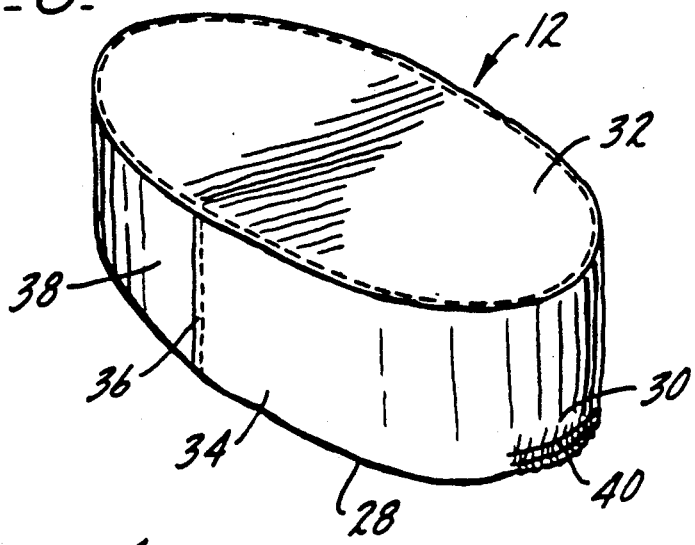
FIG. 3 is a perspective view of a liner of the present invention prior to its installation in a hard hat.
Figure 4:
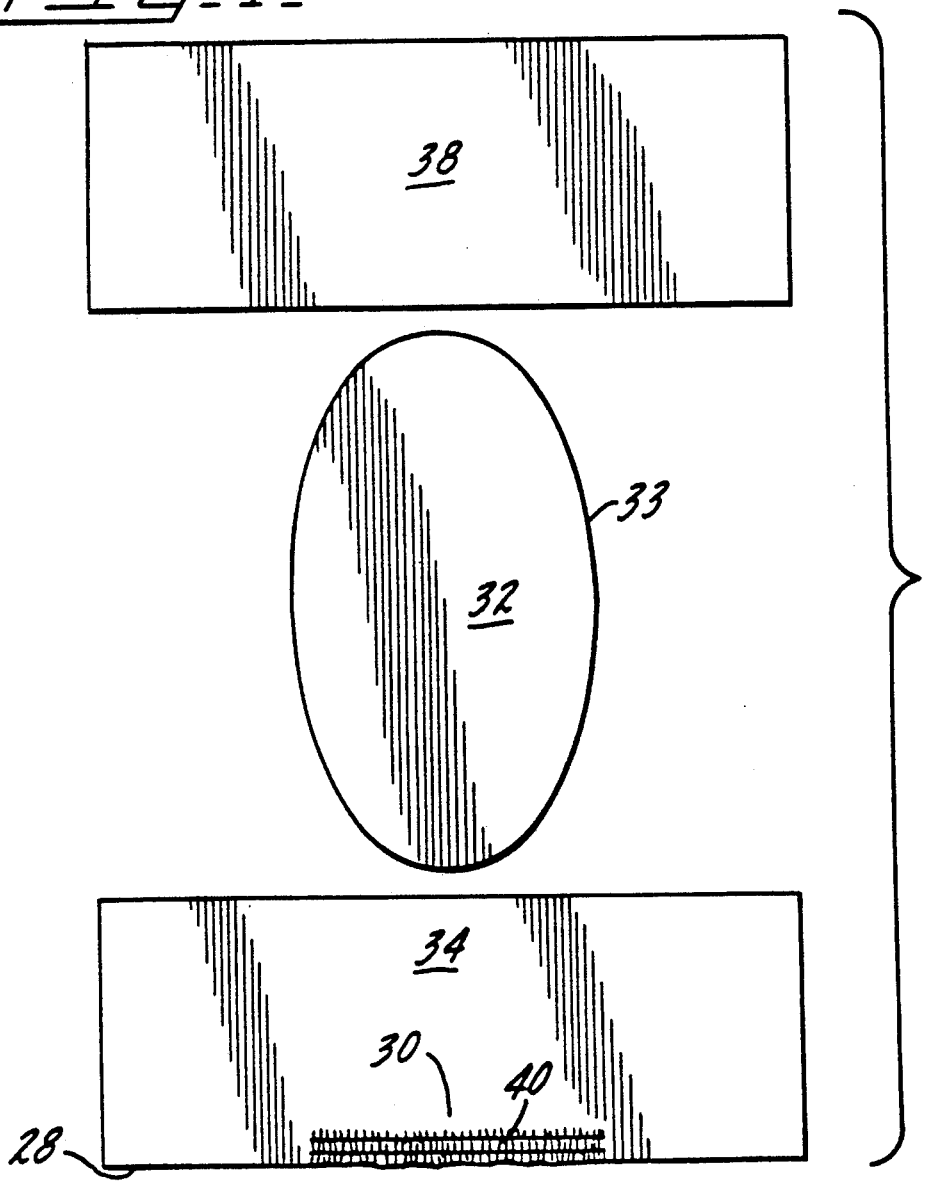
FIG. 4 is a top plan view of the components used to construct the liner shown in FIG. 3.

FIGS. 3 and 4 show the construction of the liner 12. The liner 12 is made of three elements, an oval top section 32, a front wall section 38, and a rear wall section 34. The elements 32, 34 and 38 are stitched together to form a generally concave shape. The front and rear wall sections 34 and 38 are stitched to the outer periphery of the oval top 32. The front wall section 38 is stitched to the rear wall section 34 along a first seam 36 and a second seam (not shown) to form a circumferentially continuous lower edge 32. The rear wall section 34 includes a gathered section 30 to which is attached a piece of elasticized banding 40, stitched thereto, which provides the extreme lower edge 28 of the liner with a resilient gripping action. The rear wall section 34, as shown in FIG. 4, is in its extended position, a position which would require some slight tension in order to be maintained. When relaxed, the gathered section 30 will pucker somewhat to form pleats which may be regular or uneven.

FIG. 4 shows the rectangular shape of the front and rear wall sections 34 and 38. When the wall sections are stitched together, the form a generally cylindrical shape. The wall sections 34 and 38 should extend from the oval top 32 a substantial distance so that the extreme lower edge 28 can be easily stretched and folded around the visor 14 after the gathered section 30 is first placed over the rear part of the band 18. In order to do so, the wall sections should be at least approximately 4 inches in width between the point at which they are connected to the periphery 33 of the oval top 32 and the lower edge 28. Sides of such length, together with an oval top with a minor diameter of approximately 6 inches and a major diameter of approximately 12 inches, will provide ease of installation and removal, and make a liner which is suitable for use with most hard hats. The dimensions described above provide a loose, yet reasonably close, conformance to the shape of the interior of a hard hat. Because the elastic band 40 is positioned adjacent to the lower edge 28, the length of the lower edge 28 will be somewhat less than the length of the periphery 33 of the top edge 32, when the lower edge 28 is in the relaxed state. A difference in the length of the edge 28 between the extended and relaxed states of about 2 inches has been found to be effective. Such differences can be achieved with an elastic band of about 4 inches in length. It should be noted that significantly longer lengths of elastic banding could be used. But such lengths would be more expensive than the 4 inch piece shown in the drawings. Furthermore, increased gathering and elastic could cause the liner to have a tendency to grip the hard hat too tightly. An overly tight lower edge may result in the liner riding up the outside surface of the hard hat and withdrawing the liner from within the hat. However, when the lower edge 28 is stretched, it can assume a length which is substantially equal to the periphery of the top edge 32.

The material used to make the liner 12 should be of a soft, flaccid, and breathable material, since it will be in contact with a substantial portion of the skin of the user at the forehead and, perhaps, the ears. As used in this specification, the term "breathable material" is intended to include material with surface features which allow circulation of air on one or both sides of the material, but which does not allow flow of liquid, such as perspiration, through the material. It may also be desired to provide a material for the liner which is absorbent in order to prevent excessive buildup of perspiration. The absorbance of the material should not be such as to compromise the protective barrier provided by the liner. In fact, the material could include an impermeable layer with an absorbent, breathable surface layer which contacts the user's skin. Particularly suitable material for use in the present invention is some form of a material known as Tyvek® sheeting, which allows air and water vapor to flow through the material, but which does not allow the flow of liquid.

While a specific embodiment of the invention has been shown and described, it will be apparent to those skilled in the art that numerous alternatives, modifications, and variations of the embodiment shown can be made without departing from the spirit and scope of the appended claims.

I claim:

1. A disposable liner for headwear comprising a discrete flexible, generally concavely shaped sheet, said liner being temporarily attachable to and readily removable from a generally rigid piece of headwear and not being permanently affixed thereto, said sheet having a top and generally downwardly extending sides, said sides being made of a generally flaccid material, said sides including an elongated, foldable, circumferentially continuous lower portion, at least one segment of said lower portion being gathered and held by resiliently stretchable retaining means, whereby said elongated lower portion extends a substantial distance from inside said headwear and can resiliently engage and be removably retained by lower sections of said headwear upon being folded around said sections, said liner being easily insertable into and removable from said headwear.

2. A liner for headwear in accordance with claim 1 wherein:

said retaining means comprises a length of an elastic strip firmly attached to said segment.

3. A liner for headwear in accordance with claim 1 wherein:

said top is a generally flat oval-shaped piece of flexible material, and said sides are formed from at least one generally flat rectangular pieces attached to an outer peripheral edge of said top to form a generally cylindrical configuration.

4. A liner for headwear in accordance with claim 3 wherein:

said sides extend from said top a distance of at least approximately 4 inches so that said sides may be easily folded over the periphery of said headwear.

5. A liner for headwear in accordance with claim 1 wherein:

said flaccid material is a soft, breathable material.

6. A liner for headwear in accordance with claim 5 wherein:

said flaccid material is moisture absorbent.

7. In combination with a hard hat of the type which includes an outer shell of generally rigid material and an inner support framework, said framework including an annular retention band for engaging the wearer's head, a disposable liner comprising a concavely shaped sheet having a top and elongated downwardly extending sides, said sheet being made of generally flaccid material, said sides defining a lower edge, at least a portion of said lower edge being gathered and held by resiliently stretchable retaining means, and said retaining means acting to retain said liner in resilient engagement with at least a portion of lower edge of said hard hat, said liner being easily removable from said hard hat by disengagement of said resilient retaining means from said lower edge, said liner covering substantially all interior surfaces of said hard hat, preventing contact between any portion of said framework and the wearer's head.

8. A liner for hard hats in accordance with claim 7 wherein:

said retaining means comprises a length of an elastic strip firmly attached to said segment.

9. A liner for hard hats in accordance with claim 7 wherein:

said top is a generally flat oval-shaped piece of flexible material, and said sides are formed from at least one generally flat rectangular pieces attached to an outer peripheral edge of said top to form a generally cylindrical configuration.

10. A liner for hard hats in accordance with claim 9 wherein:

said sides extend from said top a distance of at least approximately 4 inches so that said sides may be easily folded over the periphery of said headwear.

11. A liner for hard hats in accordance with claim 7 wherein:

said flaccid material is a soft, breathable material.

12. A liner for hard hats in accordance with claim 11 wherein:

said flaccid material is moisture absorbent.

* * * * *